US010953652B2

(12) United States Patent
Nitta et al.

(10) Patent No.: US 10,953,652 B2
(45) Date of Patent: Mar. 23, 2021

(54) INK JET HEAD AND INK JET PRINTER

(71) Applicant: TOSHIBA TEC KABUSHIKI KAISHA, Tokyo (JP)

(72) Inventors: Noboru Nitta, Tagata Shizuoka (JP); Shinichiro Hida, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/278,934

(22) Filed: Feb. 19, 2019

(65) Prior Publication Data

US 2019/0255841 A1 Aug. 22, 2019

(30) Foreign Application Priority Data

Feb. 20, 2018 (JP) ..... 2018-027579

(51) Int. Cl.
*B41J 2/14* (2006.01)
*B41J 2/045* (2006.01)

(52) U.S. Cl.
CPC ..... *B41J 2/04541* (2013.01); *B41J 2/04586* (2013.01); *B41J 2/1433* (2013.01); *B41J 2/14201* (2013.01); *B41J 2002/14459* (2013.01); *B41J 2002/14491* (2013.01)

(58) Field of Classification Search
CPC .. B41J 2/04541; B41J 2/14201; B41J 2/1433; B41J 2/04586; B41J 2002/14459; B41J 2002/14491; B41J 2/14233; B41J 2/01; B41J 2002/14258
See application file for complete search history.

(56) References Cited

U.S. PATENT DOCUMENTS

| | | | |
|---|---|---|---|
| 6,190,006 | B1 | 2/2001 | Kurashima et al. |
| 7,722,157 | B2 | 5/2010 | Temple |
| 10,259,215 | B2 | 4/2019 | Tanaka |
| 2003/0063449 | A1 | 4/2003 | Suzuki et al. |

(Continued)

FOREIGN PATENT DOCUMENTS

| | | | | |
|---|---|---|---|---|
| JP | 11-251524 | * | 9/1999 | ..... H01L 21/822 |
| JP | 2004-098579 | A | 4/2004 | |

(Continued)

OTHER PUBLICATIONS

Machine translation of JP 2007-083707, published on Apr. 2007 (Year: 2007).*

(Continued)

*Primary Examiner* — Huan H Tran
(74) *Attorney, Agent, or Firm* — Kim & Stewart LLP

(57) ABSTRACT

An ink jet head includes a first substrate, a second substrate, a plurality of ink jet elements, and a drive circuit. The ink jet elements are configured to cause ink to be ejected from a plurality of nozzles. The drive circuit is provided on the first or second substrate and configured to drive the plurality of ink jet elements. The first substrate includes a first wiring. The second substrate is coupled to the first substrate, and includes a second wiring overlaid on the first wiring at a connection region. A thickness of the first wiring is less than a thickness of the second wiring at the connection region. A width of the first wiring at the connection region is greater than a width of the second wiring at the connection region.

20 Claims, 13 Drawing Sheets

(56) References Cited

U.S. PATENT DOCUMENTS

| | | | |
|---|---|---|---|
| 2005/0286240 | A1 | 12/2005 | Sakamoto et al. |
| 2007/0222822 | A1 | 9/2007 | Ito |
| 2008/0074795 | A1 | 3/2008 | Kobayashi |
| 2012/0069527 | A1 | 3/2012 | Yamashita |
| 2017/0239940 | A1 | 8/2017 | Yamashita |

FOREIGN PATENT DOCUMENTS

| | | | |
|---|---|---|---|
| JP | 3525046 | B2 | 5/2004 |
| JP | 2007083707 | A | 4/2007 |
| JP | 2007-196433 | A | 8/2007 |
| JP | 2008-141078 | A | 6/2008 |
| JP | 2009004278 | A | 1/2009 |
| JP | 2010-214772 | A | 9/2010 |
| JP | 4815296 | B2 | 11/2011 |
| JP | 2016-134453 | A | 7/2016 |
| WO | 2004/021268 | A1 | 3/2004 |
| WO | 2016147634 | A1 | 9/2016 |

OTHER PUBLICATIONS

Machine translation of JP 2009-004278, published on Jan. 2009 (Year: 2009).*

Machine translation of JP 2016-134453, published on Jul. 2016 (Year: 2016).*

U.S. Appl. No. 16/276,117, filed Feb. 14, 2019 (First Inventor: Noboru Nitta).

U.S. Appl. No. 16/276,179, filed Feb. 14, 2019 (First Inventor: Noboru Nitta).

U.S. Appl. No. 16/277,542, filed Feb. 15, 2019 (First Inventor: Noboru Nitta).

Extended European Search Report dated Jun. 21, 2019, filed in counterpart European Patent Application No. 19158048.9, 8 pages.

Chinese First Office Action dated Sep. 8, 2020 mailed in Chinese Patent Application No. 201910111190.7, 13 pages (with Translation).

European Communication from the Examining Division dated Jun. 26, 2020 mailed in counterpart European Patent Application No. 19158048.9, 5 pages.

* cited by examiner

INK JET HEAD AND INK JET PRINTER

CROSS-REFERENCE TO RELATED APPLICATION

This application is based upon and claims the benefit of priority from Japanese Patent Application No. 2018-027579, filed Feb. 20, 2018, the entire contents of which are incorporated herein by reference.

FIELD

Embodiments described herein relate generally to an ink jet head and an ink jet printer.

BACKGROUND

An ink jet head includes a flow path formation member in which a plurality of ink chambers are formed, a nozzle plate on which a plurality of nozzles that communicate with the respective ink chambers are formed, and a head substrate on which a plurality of elements, such as actuators, corresponding to the ink chambers are arranged.

The head substrate may be connected to a printer control unit via a flexible substrate, a relay substrate, a cable, or the like. A drive integrated circuit (IC) chip that drives the plurality of elements may be mounted on the flexible substrate.

The drive IC outputs drive power in accordance with a command from the printer control unit and supplies the drive power to the respective elements. In this manner, the elements are deformed or caused to generate heat and, an ink pressure in the pressure chamber increases, and thus ink is ejected from the nozzles.

Individual wires for supplying drive signals and a common wiring for supplying a reference potential (ground potential) are connected to the respective elements.

The common wiring may be disposed via a different route without the flexible substrate interposed therebetween or is disposed via the drive IC chip on the flexible substrate.

If the common wiring is disposed through a path that is separate from the flexible substrate, the wiring may become long and complicated. This may increase noise or lead to degradation of ejection properties due to voltage dropping. Also, a wiring connecting operation may become cumbersome.

If the common wiring is disposed via the drive IC chip on the flexible substrate, improper operations of the drive IC may occur due to noise that is transmitted through the common wiring. Also, the common wiring may need to be formed with a thin width, and this may lead to degradation of ejection properties due to voltage dropping. If the width of the common wiring is increased, an area of the drive IC chip may increase.

DESCRIPTION OF THE DRAWINGS

FIG. 1A illustrates an example and FIG. 1B illustrates a modification example.

FIG. 2A illustrates a state before bonding and FIG. 2B illustrates a state after bonding.

FIG. 3A illustrates a cross-sectional view along A-A in FIG. 2B, FIG. 3B illustrates a cross-sectional view along B-B in FIG. 2B, FIG. 3C illustrates an enlarged view of apart C in FIG. 2B, and FIG. 3D is an enlarged view of a part D in FIG. 2B, and FIG. 3E is an enlarged view of a part E in FIG. 2B.

FIG. 5A illustrates a state before bonding and FIG. 5B illustrates a state after bonding.

FIG. 12A illustrates two flexible substrates separated from each other, and FIG. 12B illustrates two flexible substrates arranged in the vicinity of each other.

DETAILED DESCRIPTION

Figure 1A:
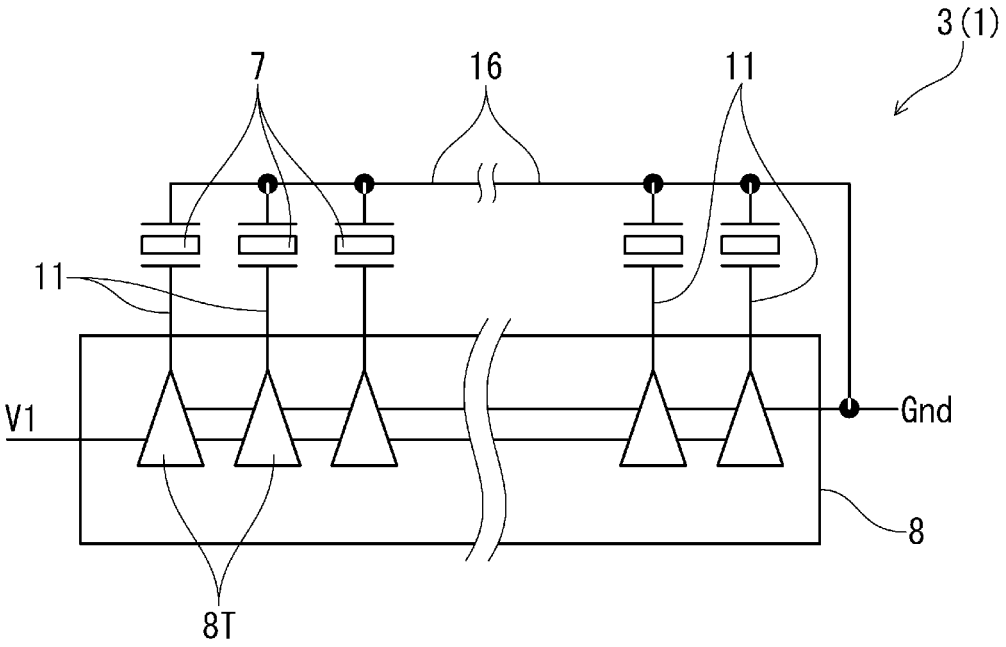
FIGS. 1A and 1B are diagrams illustrating a configuration of an electrical circuit in an ink jet head according to an embodiment, where

Embodiments provide an ink jet head and an ink jet printer capable of avoiding deterioration of wiring resistance at connection between a first wiring substrate and a second wiring substrate and preventing ejection properties from being degraded.

An ink jet head includes a first substrate, a second substrate, a plurality of ink jet elements, and a drive circuit. The ink jet elements are configured to cause ink to be ejected from a plurality of nozzles. The drive circuit is provided on the first or second substrate and configured to drive the plurality of ink jet elements. The first substrate includes a first wiring. The second substrate is coupled to the first substrate, and includes a second wiring overlaid on the first wiring at a connection region. A thickness of the first wiring is less than a thickness of the second wiring at the connection region. A width of the first wiring at the connection region is greater than a width of the second wiring at the connection region.

In a specific embodiment, an ink jet head includes a head substrate and a flexible substrate coupled to the head substrate. The head substrate includes a plurality of ink jet elements configured to cause ink to be ejected from a plurality of nozzles and a first wiring electrically connected to an ink jet element. The flexible substrate includes a drive circuit (e.g., integrated circuit) configured to drive the ink jet elements and a second wiring overlaid on the first wiring at a connection region. A width of the first wiring at the connection region is greater than a width of the second wiring at the connection region, and a thickness of the first wiring at the connection region is less than a thickness of the second wiring at the connection region.

Hereinafter, an ink jet head and an ink jet printer according to example embodiments will be described with reference to drawings. In the drawings, the same reference numerals will be used for the same aspects.

First Embodiment

Ink Jet Heads 3

Figure 1B:
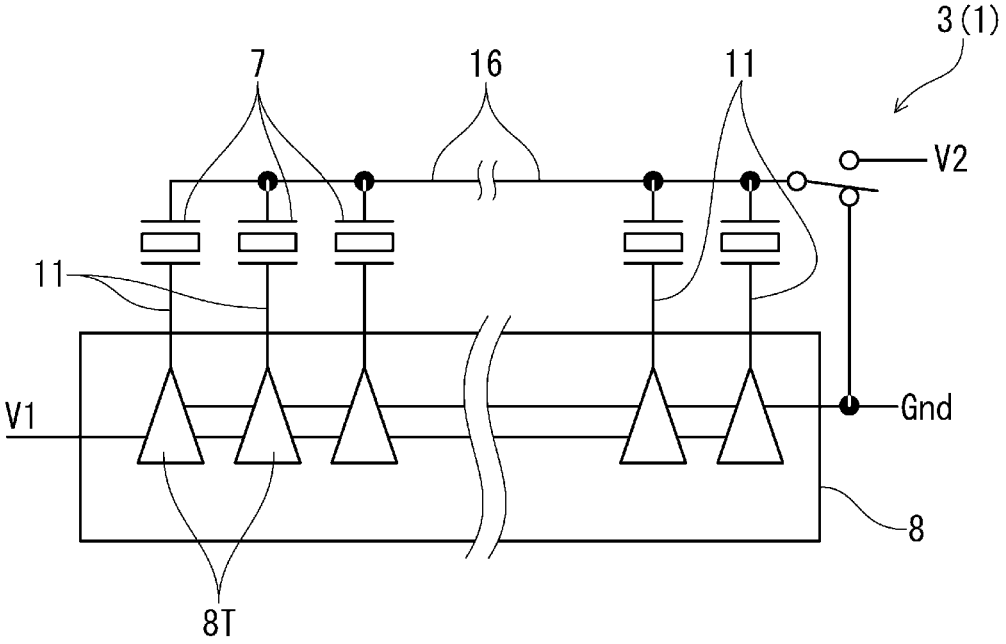

FIGS. 1A and 1B are diagrams illustrating a configuration of electrical circuits in an ink jet head 3. FIG. 1A illustrates an example and FIG. 1B illustrates a modification example.

The ink jet printer 1 includes a plurality of ink jet heads 3. The ink jet printer 1 includes an ink supply unit configured to supply ink to the ink jet heads 3, a medium transport unit configured to transport a recording medium to the ink jet heads 3, a printer control unit, and the like.

Each ink jet head 3 includes a plurality of actuators 7, a drive IC 8, and the like. The drive IC 8 includes a drive circuit including output transistors 8T.

Each of the actuators 7 has one end connected to a discrete wiring 11 and the other end connected to a common wiring 16.

The discrete wiring 11 is a wiring that is individually connected to a corresponding one of the actuators 7 and is also connected to the drive IC 8. The common wiring 16 is a shared wiring that is connected to the actuators 7 and is grounded. That is, each actuator 7 is connected to a drive circuit of the drive IC 8 via a different discrete wiring 11 and is connected to a reference potential GND (0 V) via the shared common wiring 16.

The drive circuit of the drive IC 8 selectively controls the output transistors 8T to supply a drive potential V1 or a reference potential GND. If the drive circuit of the drive IC 8 controls an output transistor 8T to supply the drive potential V1, the corresponding actuator 7 is charged to the drive potential V1. If the drive circuit of the drive IC 8 controls an output transistor 8T to have the reference potential GND, the corresponding actuator 7 is caused to discharge electricity to reach the reference potential GND.

Figure 2A:
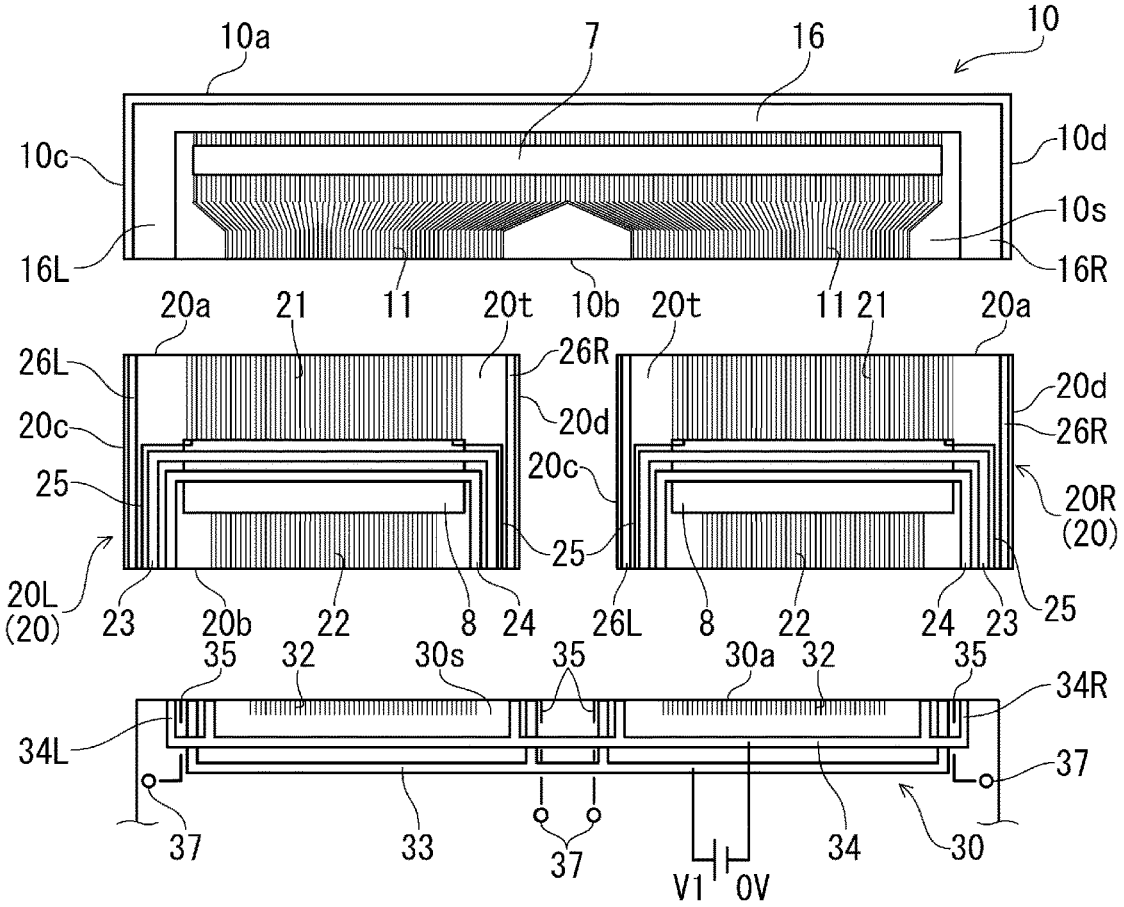
FIGS. 2A and 2B are diagrams illustrating an ink jet head according to a first embodiment, where
Figure 2B:
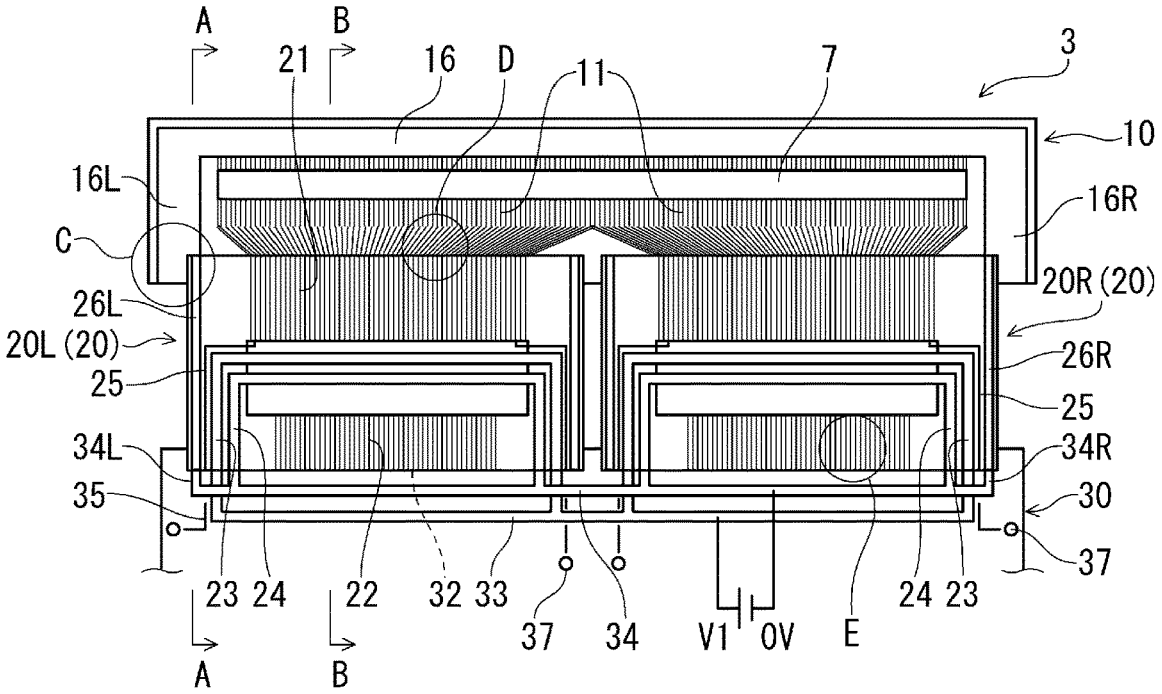

FIGS. 2A and 2B are diagrams illustrating an ink jet head 3 according to a first embodiment, where FIG. 2A illustrates a state before bonding and FIG. 2B illustrates a state after bonding. A flexible substrate 20 and a relay substrate 30 are illustrated with wirings and the like in a manner in which the wirings and the like are seen through the respective substrates, for convenience of explanation.

Figure 3A:
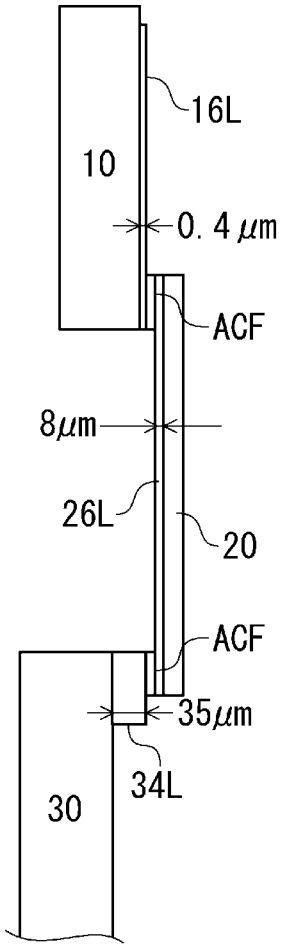
FIGS. 3A to 3E are diagrams illustrating the ink jet head according to the first embodiment, where
Figure 3B:
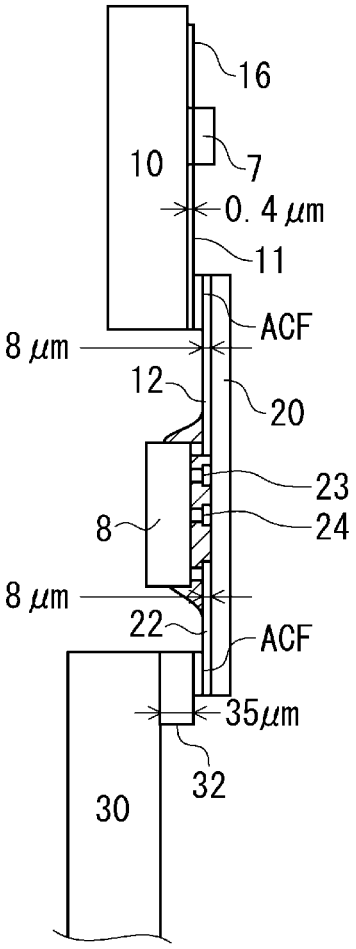
Figure 3C:
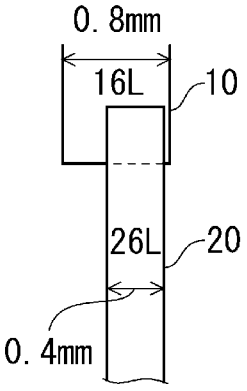
Figure 3D:
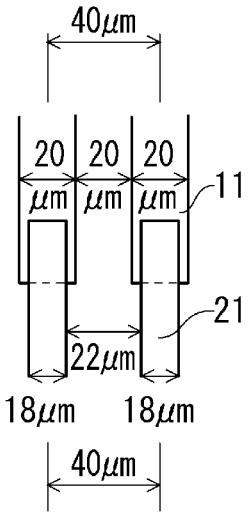
Figure 3E:
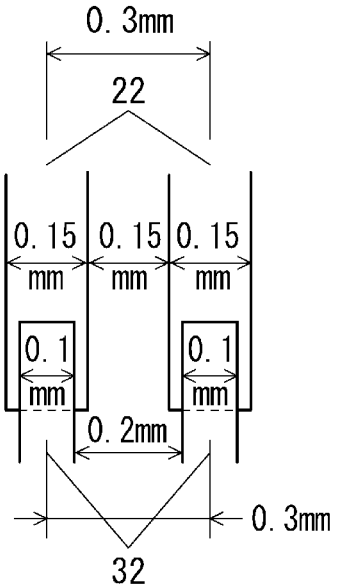

FIGS. 3A to 3E illustrate diagrams illustrating the ink jet head according to the first embodiment, where FIG. 3A illustrates a cross-sectional view along A-A in FIG. 2B, FIG. 3B illustrates a cross-sectional view along B-B in FIG. 2B, FIG. 3C illustrates an enlarged view of a part C in FIG. 2B, FIG. 3D illustrates an enlarged view of a part D in FIG. 2B, and FIG. 3E illustrates an enlarged view of a part E in FIG. 2B. Only the respective wirings are illustrated in FIGS. 3C to 3E for convenience of explanation.

The ink jet head 3 includes a head substrate 10, a flexible substrate 20, and a relay substrate 30.

In the head substrate 10, a plurality of actuators 7 corresponding to ink chambers, respectively, are arranged. The flexible substrate 20 and the relay substrate 30 are bonded to the head substrate 10.

In the following description, the longitudinal (length) direction of the head substrate 10 will be referred to as X direction or a left-right direction. +X direction will be referred to as a right direction, and −X direction will be referred to as a left direction. The end in −X direction (first terminal) and the end in +X direction (second end) will collectively be referred to as both ends.

The short side (width) direction of the head substrate 10 will be referred to as Y direction or an upper-lower direction. +Y direction will be referred to as an upper direction or an output direction, and −Y direction will be referred to as a lower direction or an input direction. The thickness direction of the head substrate 10 will be referred to as Z direction. +Z direction will be referred to as a front direction, and −Z direction will be referred to as a rear direction.

In addition, electrical coupling will be referred to as "connecting," and physical coupling will be referred to as "bonding."

The head substrate 10, the flexible substrate 20, and the relay substrate 30 are sequentially bonded to each other in Y direction. The head substrate 10 is arranged in +Y direction with respect to two flexible substrates 20, the relay substrate 30 is arranged in −Y direction with respect to the two flexible substrates 20. That is, the two flexible substrates 20 are bridged in parallel between the head substrate 10 and the relay substrate 30.

An edge 20*a* on the output side of the flexible substrate 20 overlaps an edge 10*b* on the input side of the head substrate 10. An edge 20*b* on the input side of the flexible substrate 20 overlaps an edge 30*a* on the output side of the relay substrate 30.

Head Substrate 10

Figure 10:
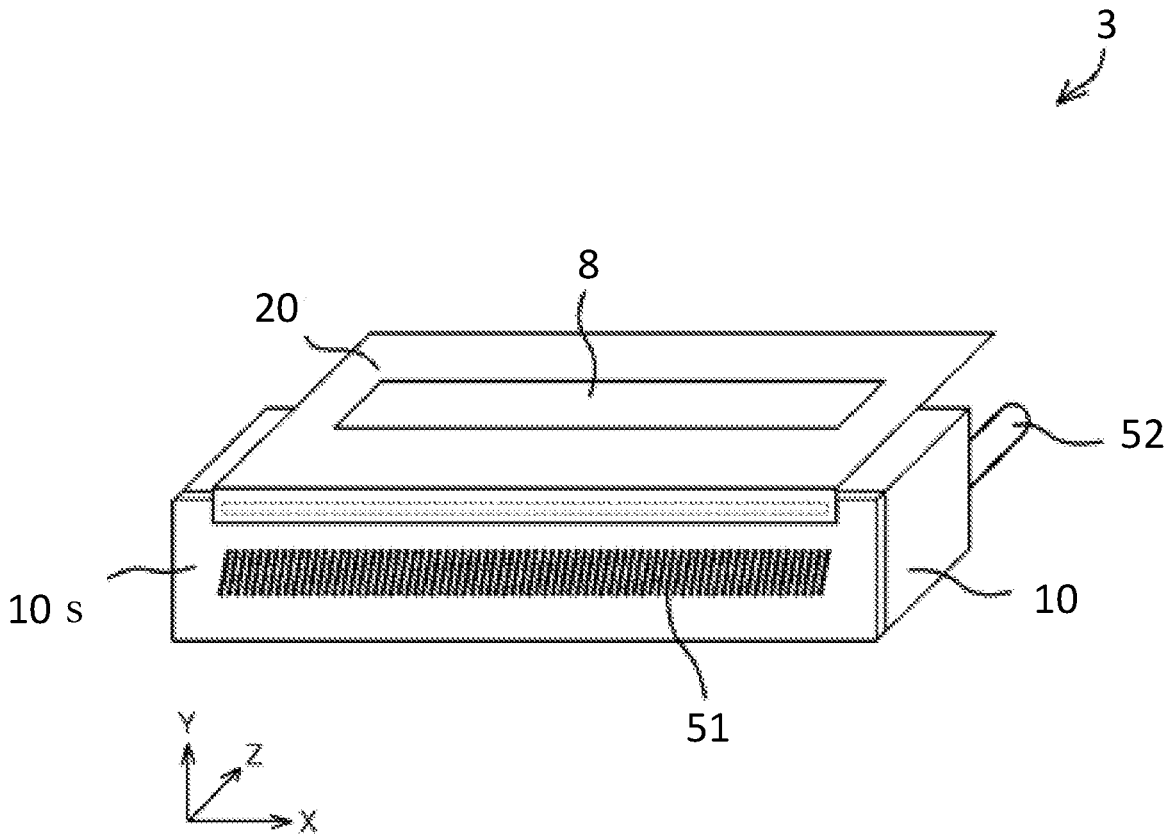
FIG. 10 illustrates a perspective view of the ink jet head.
Figure 11:
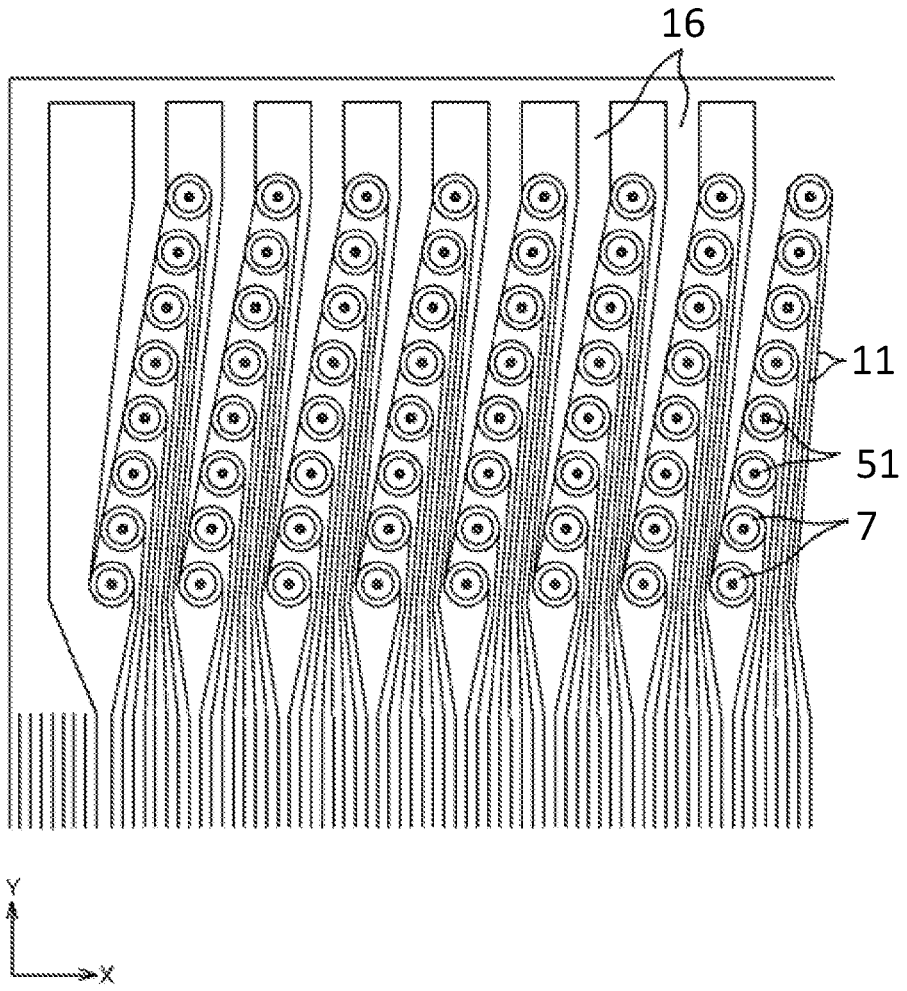
FIG. 11 illustrates a partially enlarged view of a front surface of the head substrate.

FIG. 10 illustrates a perspective view of the ink jet head 3. FIG. 11 illustrates a partially enlarged view of a front surface (nozzle plate) 10*s* of the head substrate 10. The head substrate 10 is a single-sided hard substantially inflexible substrate made of silicon or glass, and a planar shape thereof is a rectangular shape. The head substrate 10 has a plurality of actuators 7. The actuators 7 are piezoelectric elements, for example. The plurality of actuators 7 are microelectromechanical systems (MEMS) and are arranged on a front surface 10*s* of the head substrate 10. For example, 1000 actuators 7 are provided. The actuator 7, which is a driving source for ejecting ink, is provided for each nozzle 51. Each of the actuators 7 is formed in an annular shape, and the actuators 7 are arranged so that the nozzles 51 are located at the center thereof.

The plurality of actuators 7 are aligned in parallel in the left-right direction. In one implementation, the actuator 7 includes eight actuators 7 arranged in Y axis direction as one set in X axis direction. For example, 150 sets are arranged in X axis direction, and a total of 1200 actuators 7 are arranged.

A plurality of nozzles 51 for ejecting ink are arranged on a front surface 10*s* of the head substrate 10. The nozzles 51 are two-dimensionally arranged in the column direction (X direction) and the row direction (Y direction). However, the nozzles 51 arranged in the row direction (Y direction) are arranged obliquely so that the nozzles 51 do not overlap on the axis of the Y axis. The ink ejected from each nozzle 51 is supplied from the ink supply path 52 communicating with the nozzle 51.

In addition, the head substrate 10 has discrete wirings 11 and a common wiring 16. The discrete wirings 11 and the common wiring 16 are connected to the actuators 7.

The discrete wirings 11 are a plurality of wirings that are disposed in parallel from the respective actuators 7 to the edge 10*b* on the input side on the front surface 10*s*. The drive potential V1 or the reference potential GND is supplied to the discrete wirings 11.

The number of the discrete wirings 11 is the same as the number of the actuators 7. The number of the discrete wirings 11 is 1200, for example.

Wirings extending from the actuators 7 to the common wiring 16 are disposed in parallel to each other from the respective actuators 7 toward the edge 10*a* on the output side on the front surface 10*s*. These wirings connected to the actuators 7 are commonly connected to the common wiring 16 at the edge 10*a*, and the common wiring 16 is disposed toward both left and right ends along the edge 10*a*. Further, the common wiring 16 is disposed from both left and right ends of the edge 10*a* to the edge 10*b* along the edges 10*c* and 10*d* on the left and right sides. That is, the common wiring 16 is a single wiring, is disposed along the edges 10*a*, 10*c*, and 10*d* except for the edge 10*b*, is further branched from the edge 10*a*.

The reference potential GND is supplied to the common wiring 16.

Common wirings 16L and 16R are respectively arranged at both left and right ends at the edge 10*b* of the head substrate 10. The plurality of discrete wirings 11 are arranged between the common wirings 16L and 16R. The discrete wirings 11 are divided into two on the left and right sides of the edge 10*b*. For example, 500 discrete wirings 11 are arranged on the left side, and 500 discrete wirings 11 are arranged on the right side of the edge 10*b*.

Since the discrete wirings 11 are divided into two on the left and right sides of the edge 10*b*, the discrete wirings 11 are disposed so as to be inclined relative to X direction between the actuators 7 and the edge 10*b*.

The discrete wirings 11 and the common wiring 16 are formed of nickel, aluminum, gold, or an alloy thereof. Since these wirings are formed through a semiconductor process, film thicknesses of conductive bodies are relatively thin. Specifically, line thicknesses of the discrete wirings 11 and the common wiring 16 are 0.4 μm (see FIGS. 3A and 3B).

The line width, the wiring interval, and the arrangement interval (pitch) of the discrete wirings 11 are 20 μm, 20 μm, and 40 μm, respectively, at the edge 10*b*. The line widths of the common wirings 16L and 16R are 0.8 mm (see FIGS. 3C and 3D).

Flexible Substrate 20

The flexible substrate 20 is a single-sided soft substrate made of a synthetic resin film, such as polyimide, and a planar shape thereof is a rectangular shape. The flexible substrate 20 is also referred to as a flexible film substrate or a flexible printed circuit (FPC). A flexible substrate 20L on the left side and a flexible substrate 20R on the right side have the same shape and configuration.

Each flexible substrate 20 has a single drive IC 8. The drive IC 8 is mounted on a rear surface 20*t* of the flexible substrate 20, which is a surface opposite to a front surface of the flexible substrate 20 depicted in FIG. 2. The drive IC 8 is arranged in the left-right direction at the center of the flexible substrate 20, and the respective terminals are sealed with resin.

Each flexible substrate 20 can be considered as a package of the drive IC 8, a sealed state in which the drive IC 8 is mounted on the flexible substrate 20 is also referred to as a tape carrier package (TCP) or a chip-on-film (COF) package.

In addition, each flexible substrate 20 has output wirings 21, input wirings 22, a power source wiring 23, a ground wiring 24, output monitor wirings 25, and common connection wirings 26.

The wirings except for the common connection wirings 26 are connected to the drive IC 8. That is, the output wirings 21, the input wirings 22, the power source wiring 23, the ground wiring 24, and the output monitor wirings 25 are connected to the drive IC 8.

Meanwhile, the common connection wirings 26 are independently disposed without being connected to the drive IC 8 and the other wirings.

The output wirings 21 are a plurality of wirings disposed in parallel to each other from the drive IC 8 to the edge 20*a* on the output side on the rear surface 20*t*. The output wirings 21 are respectively connected to a plurality of output terminals provided on the rear surface of the drive IC 8. The drive potential V1 or the reference potential GND is supplied to the output wirings 21.

The number of output wirings 21 is a half of the number of the discrete wirings 11. The number of the output wirings 21 is 600, for example.

The input wirings 22 are a plurality of wirings that are disposed in parallel to each other from the drive IC 8 to the edge 20*b* on the input side on the rear surface 20*t*. The input wirings 22 are respectively connected to a plurality of input terminals that are provided on the rear surface of the drive IC 8. A control signal is supplied to the input wirings 22.

The number of input wirings 22 is smaller than the number of the output wirings 21. The number of the input wirings 22 is 50, for example.

The power source wiring 23 and the ground wiring 24 are wirings that are arranged in such a manner in which these wirings travel across a region on which the drive IC 8 is mounted, in the left-right direction, are bent at a substantially right angle on both left and right ends, and are disposed in parallel to each other. That is, the power source wiring 23 and the ground wiring 24 are disposed to surround the output side and both left and right sides of the input wiring 22.

The power source wiring 23 is connected to a plurality of power source terminals that are provided on the rear surface of the drive IC 8. The drive potential V1 is supplied to the power source wiring 23.

The ground wiring 24 is connected to a plurality of ground terminals that are provided on the rear surface of the drive IC 8. The reference potential GND is supplied to the ground wiring 24.

The number of the power source wirings 23 is one, and the number of the ground wirings 24 is one. The power source wiring 23 is arranged on the output side and the left and right outer sides, and the ground wiring 24 is arranged on the input side and the left and right inner sides.

The output monitor wirings 25 are two wirings that are disposed from the drive IC 8 to the edge 20*b* on the input side. The output monitor wirings 25 may be connected to any of a plurality of output terminals that are provided on the rear surface of the drive IC 8. That is, the output monitor wirings 25 may be connected to any of the plurality of output wirings 21. Drive waveforms that are changed between the drive potential V1 and the reference potential GND by the drive IC 8 are supplied to the output monitor wirings 25.

One output monitor wiring 25 is arranged on each of the left and right sides. Each output monitor wiring 25 is drawn out from ends of the output wirings 21, is directed from the region on which the drive IC 8 is mounted to both left and right ends, is bent at a right angle, and is disposed to reach the edge 20*b*. The output monitor wirings 25 are arranged on the output side and the left and right outer sides of the power source wiring 23 and are disposed in parallel to the power source wiring 23.

The common connection wirings 26 are two wirings disposed in the upper-lower direction along the left and right edges 20*c* and 20*d* on the rear surface 20*t*. That is, a common connection wiring 26L is arranged on the leftmost edge while a common connection wiring 26R is arranged on the rightmost edge. The common connection wirings 26L and 26R are disposed to directly connect the edge 20*b* and the edge 20*a* without being connected to the drive IC 8 and the like. The reference potential GND is supplied to the common connection wirings 26.

The ground wiring 24 and the common connection wirings 26 are separate from each other. In other words, the ground wiring 24 and the common connection wirings 26 are independently connected to the relay substrate 30 and are electrically connected to each other on the relay substrate 30.

A plurality of input wirings 22 are aligned at the edge 20*b* of the flexible substrate 20, the ground wiring 24 is disposed outside the plurality of input wirings 22, and the power source wiring 23 is disposed further outside the ground wiring 24. Since the flexible substrate 20 is a one-sided substrate, wirings on the flexible substrate cannot cross the other wirings.

Basically, since the common connection wirings 26 and the drive IC 8 are separate from each other on the flexible substrate 20, it is possible to dispose the route of the output monitor wirings 25 to start from any of the output wirings 21, pass between the common connection wirings 26 and the power source wiring 23, and reach the edge 20*b* without crossing the other wirings.

Note that the embodiment is not limited to a case in which the power source wiring 23 is disposed outside the ground wiring 24, and the ground wiring 24 may be disposed outside the power source wiring 23 in some cases.

The output wirings 21, the input wirings 22, the power source wiring 23, the ground wiring 24, the output monitor wirings 25, and the common connection wirings 26 are formed of copper. These wirings are formed by using an adhesive on a polyimide film or by performing electrolytic plating and then performing patterning thereon. Therefore, the conductor thicknesses can have thicker than those of the discrete wirings 11 and the common wiring 16 on the head substrate 10. The line thicknesses of the respective wirings from the output wirings 21 to the common connection wirings 26 are 8 μm (see FIGS. 3A and 3B).

At the edge 20*a*, the arrangement interval (pitch) of the output wirings 21 is 40 μm, which is the same as that of the discrete wirings 11. The line width of the output wirings 21 is 18 μm, which is smaller than that of the discrete wirings 11. The wiring interval of the output wirings 21 is 22 μm, which is greater than that of the discrete wirings 11 (see FIG. 3D).

Since the wirings on the flexible substrate 20 have thicknesses that are about twenty times as large as those of the wirings on the head substrate 10, sheet resistance is substantially lower than that of the wirings on the head substrate 10. If the line widths of the wirings on the head substrate 10, having high sheet resistance, are reduced, wiring resistance significantly increases. Meanwhile, an increase in resistance is relatively small even if the line widths of the wirings on the flexible substrate 20, having low sheet resistance, are reduced. By reducing the line widths of the output wirings 21 on the polyimide film side to 18 μm and setting a wiring interval to be as large as 22 μm corresponding to the narrowed width, an increase in resistance is suppressed, and insulating defects are prevented even if deviation occurs during connection.

The line width of the common connection wiring 26 is 0.4 mm, which is a half of those of the common wirings 16L and 16R (see FIG. 3C).

Since the thicknesses the respective wirings on the flexible substrate 20 are about twenty times as thick as those on the head substrate 10, sheet resistance is comparatively lower. If the line widths of the conductors on the head substrate 10 is reduced, wiring resistance significantly increases. However, the increase in resistance is relatively small if the line widths of the conductors on the flexible substrate 20 are reduced. By setting the width of the common connection wiring 26 on the polyimide film side to 0.4 mm, it is possible to suppress an increase in resistance and also to reduce the length of the polyimide film in X direction. In this manner, it is possible to improve operability in bonding between the flexible substrate 20 and the head substrate 10, to suppress manufacturing costs, and to suppress film costs.

The common connection wirings 26L and 26R are arranged at both left and right ends at the edge 20*a* of the flexible substrate 20. The plurality of output wirings 21 are arranged at the center of the edge 20*a*.

In this manner, if the flexible substrate 20L is bonded to the left side of the edge 10*b* of the head substrate 10, the common connection wiring 26L is connected to the common wiring 16L, and the output wirings 21 are respectively connected to the discrete wirings 11 (connection locations). The common connection wiring 26R of the flexible substrate 20L may not be connected to any wirings of the head substrate 10 and the relay substrate 30, and therefore may be referred to as a dummy wiring.

If the flexible substrate 20R is bonded to the right side of the edge 10*b* of the head substrate 10, the common connection wiring 26R is connected to the common wiring 16R, and the output wirings 21 are respectively connected to the discrete wirings 11 (connection locations). The common connection wiring 26L of the flexible substrate 20L may not be connected to any wirings of the head substrate 10 and the relay substrate 30, and therefore may be referred to as a dummy wiring.

The flexible substrate 20 and the head substrate 10 are connected via an anisotropic conductive film (ACF). The ACF is arranged between the edge 20*a* of the rear surface 20*t* of the flexible substrate 20 and the edge 10*b* of the front surface 10*s* of the head substrate 10.

If the flexible substrate 20 and the head substrate 10 are thermally press-fitted to each other with a heater or the like with the ACF interposed therebetween, the flexible substrate 20 and the head substrate 10 can be bonded to each other, and therefore, the respective wirings can be electrically connected to each other. For example, the common wirings 16L and 16R and the common connection wirings 26L and 26R are electrically connected to each other.

In a case in which stretching of the flexible substrate 20 during the thermal pressing cannot be ignored, the arrangement interval (pitch) may be formed to be narrower than 40 μm in a state before the connection such that the arrangement interval (pitch) after the connection becomes 40 μm.

The common connection wirings 26L and 26R are arranged at both left and right ends at the edge 20*b* of the flexible substrate 20. A plurality of input wirings 22 are arranged at the center of the edge 20*b*. Further, the output monitor wiring 25, the power source wiring 23, and the ground wiring 24 are arranged between the common connection wiring 26L and the input wirings 22. Similarly, the output monitor wiring 25, the power source wiring 23, and the ground wiring 24 are arranged between the common connection wiring 26R and the input wirings 22.

At the edge 20*b*, the line width, the wiring interval, and the arrangement interval (pitch) of the input wirings 22 are 0.15 mm, 0.15 mm, and 0.3 mm, respectively (see FIG. 3E). The line width of the output monitor wirings 25 is 100 μm. The line widths of the power source wiring 23, the ground wiring 24, and the common connection wiring 26 are 0.4 mm.

Relay Substrate 30

The relay substrate 30 is a hard, substantially inflexible multilayered substrate in which epoxy resin layers containing glass fibers and copper wiring layers are laminated, and a planar shape thereof is a rectangular shape.

The relay substrate 30 has electronic parts and a connector disposed or formed thereon. The relay substrate 30 also has input wirings 32, power source wirings 33, ground wirings 34, and output monitor wirings 35.

The input wirings 32, the power source wirings 33, and the ground wirings 34 are connected to the connector.

The output monitor wiring 35 is connected to a monitor pin 37 that extends from a front surface 30*s* of the relay substrate 30.

The input wirings 32 are disposed in parallel to each other from the edge 30*a* on the output side toward the connector. The input wirings 32 are exposed on the front surface 30*s* at the edge 30*a* and are arranged inside the layers at locations other than the edge 30*a*.

The number of input wirings 32 is the same as the number of input wirings 22 (for example, 50×2). The number of the discrete wirings 11 is 100, for example.

The power source wirings 33 and the ground wirings 34 are wirings that are disposed in parallel to each other from the edge 30*a* toward the connector. The power source wirings 33 are exposed on the front surface 30*s* at the edge 30*a* and are arranged inside the layers at locations other than the edge 30*a*. The ground wiring 34 is exposed on the front surface 30*s* at the edge 30*a*.

The power source wirings 33 are branched into four at the edge 20*a*. Two power source wirings 33 are arranged on the left side of the edge 20*a*, and two power source wirings 33 are arranged on the right side thereof.

The drive potential V1 for driving the actuators 7 is supplied from a power source unit (see FIG. 2B) to the power source wirings 33 via the connector or the like.

The ground wirings 34 are branched into six at the edge 30*a*. Two ground wirings 34 are arranged on the left side of the edge 20*a*, and two ground wirings 34 are arranged on the right side thereof. Further, one ground wiring 34 is arranged at each of both left and right ends of the edge 20*a* (ground wirings 34L and 34R).

The two ground wirings 34 are disposed in parallel to each other on an inner side of the two power source wirings 33 on left and right sides of the edge 20*a*. The ground wirings 34L and 34R are disposed in parallel to each other on an outer side of the power source wirings 33 at both left and right sides of the edge 20*a*.

The reference potential GND that causes the actuators 7 to discharge electricity is supplied from the power source unit to the ground wirings 34 via the connector.

The output monitor wirings 35 are four wirings that are disposed from the edge 30*a* to the four monitor pins 37. The four monitor pins 37 are arranged at arbitrary locations on the front surface 30*s* of the relay substrate 30. A necessity of adjusting drive waveforms in accordance with ink properties occurs in the ink jet head 3 in some cases. In those cases, it is possible to connect a measurement device (not illustrated) such as an oscilloscope to the four monitor pins 37 and to check the drive waveforms.

The output monitor wirings 35 are exposed on the front surface 30*s* at the edge 30*a* and are arranged inside the layers at locations other than the edge 30*a*.

The output monitor wirings 35 are disposed on an outer side of the power source wirings 33 at the edge 30*a*. The two output monitor wirings 35 are arranged in parallel to each other at the center of the edge 30*a*. The output monitor wirings 35 are disposed in parallel to each other between the ground wirings 34L and 34R and the power source wirings 33 at both left and right ends of the edge 20*a*.

The input wirings 32, the power source wirings 33, the ground wirings 34, and the output monitor wirings 35 are formed of copper. The line thicknesses of the respective wirings from the input wirings 32 to the output monitor wirings 35 are 35 μm (see FIGS. 3A and 3B). The line thicknesses of wirings on the relay substrate 30 is thicker than those on the flexible substrate 20.

At the edge 30*a*, the arrangement interval (pitch) of the input wirings 32 is 0.3 mm, which is the same as that of the input wirings 22. The line width of the input wirings 32 is 0.1 mm, which is smaller than that of the input wirings 22. The interval of the input wirings 32 is 0.2 mm, which is larger than that of the input wirings 22 (see FIG. 3E).

Since the conductive thickness of the wirings on the relay substrate 30 is about 4 times that of the wirings on the flexible substrate 20, sheet resistance is substantially lower than that of the wirings on the head substrate 10. Therefore, an increase in resistance is relatively small even if the line widths of the wirings on the relay substrate 30 is reduced.

The width of the input wirings 32 on the side of the relay substrate is set to 0.1 mm, which is narrower than 0.15 mm, which is the width of the input wirings 22. By setting the wiring interval to be as wide as 0.2 mm corresponding to the reduction in width of the input wirings 32, an increase in resistance is suppressed, and insulating defects are prevented even if deviation occurs during connection.

That is, this is similar to the aforementioned relationship between the discrete wirings 11 on the head substrate 10 and the output wirings 21 on the flexible substrate 20.

When two wiring substrates with different sheet resistance are connected to each other, the line width and the wiring interval of first wires on the first wiring substrate, having a high sheet resistance, are set to 1:1, and the line width of second wires) on the second wiring substrate, having a lower sheet resistance, is set to be narrower than the wiring interval of the first wires even if the pitch is the same. In this manner, it is possible to limit an increase in resistance and to achieve a connection that is less likely to cause insulating defects even if deviation occurs during the connection.

The line widths of the power source wirings 33 and the ground wirings 34 are 0.4 mm at the edge 30*a*. The line width of the output monitor wirings 35 is 100 μm.

At the edge 30*a* of the relay substrate 30, the ground wiring 34L, the output monitor wiring 35, the power source wiring 33, the ground wiring 34, the plurality of input wirings 32, the ground wiring 34, the power source wiring 33, and the output monitor wiring 35 are arranged in this order from the left side to the center.

At the edge 30*a* of the relay substrate 30, the ground wiring 34R, the output monitor wiring 35, the power source wiring 33, the ground wiring 34, the plurality of input wirings 32, the ground wiring 34, the power source wiring 33, and the output monitor wiring 35 are arranged in this order from the right side to the center.

In this manner, if the flexible substrate 20L is bonded to the left side of the edge 30*a* of the relay substrate 30, the respective wirings are connected to each other. That is, the input wirings 32 are connected to the input wirings 22, the power source wirings 33 are connected to the power source wiring 23, the ground wirings 34 are connected to the ground wiring 24, and the output monitor wirings 35 are connected to the output monitor wirings 25. The ground wiring 34L is respectively connected to the common connection wiring 26L on the flexible substrate 20L.

If the flexible substrate 20R is bonded to the right side of the edge 30*a* of the relay substrate 30, the respective wirings are connected to each other. That is, the input wirings 32 are connected to the input wirings 22, the power source wirings 33 are connected to the power source wiring 23, the ground wirings 34 are connected to the ground wiring 24, and the output monitor wirings 35 are connected to the output monitor wirings 25. The ground wiring 34R is respectively connected to the common connection wiring 26R on the flexible substrate 20R.

The relay substrate 30 and the two flexible substrates 20 are connected to each other via an ACF. The ACF is arranged between the edge 30*a* of the front surface 30*s* of the relay substrate 30 and the edge 20*b* of the rear surface 20*t* of the flexible substrate 20.

If the edge 30*a* of the relay substrate 30 and the edge 20*b* of the flexible substrate 20 are thermally press-fitted by a heater or the like with the ACF interposed therebetween, the relay substrate 30 and the two flexible substrates 20 can be bonded to each other, and further, the respective wirings can be electrically connected to each other. For example, the common connection wirings 26L and 26R and the ground wirings 34L and 34R are electrically connected to each other.

Figure 4:
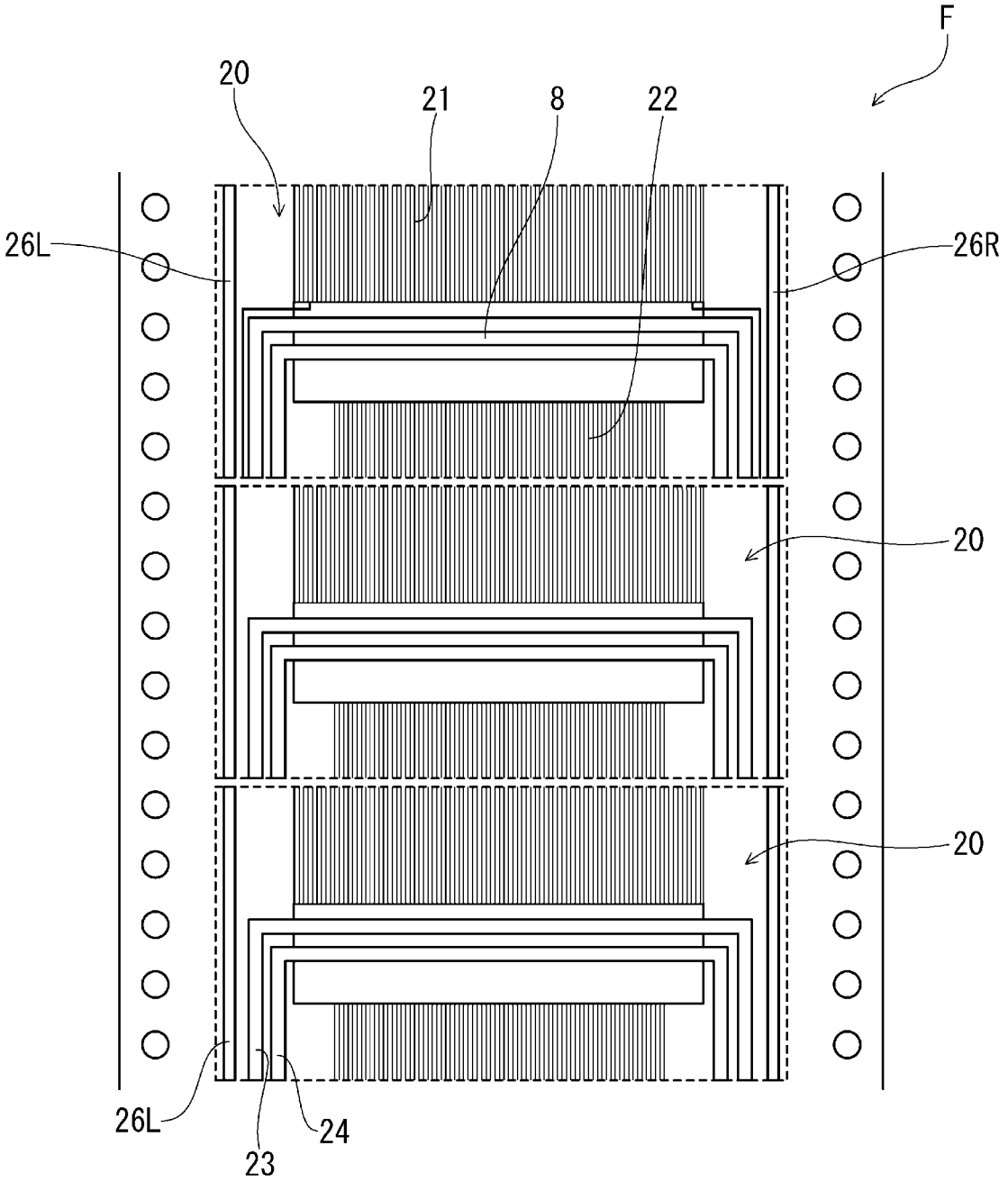
FIG. 4 is a diagram illustrating flexible substrates formed in a sprocket film.

FIG. 4 is a diagram illustrating the flexible substrates 20 formed on a sprocket film F. The flexible substrates 20 are illustrated in such a manner in which the flexible substrates 20 are seen through a synthetic resin film.

The flexible substrates 20 are continuously formed on the sprocket film F. The plurality of flexible substrates 20 are transported to an assembling plant or the like for the ink jet heads 3 while still a sprocket film F state.

When the individual flexible substrates 20 are cut from the sprocket film F, outer circumferences (broken line in FIG. 4) of the flexible substrates 20 are cut. In this manner, the flexible substrates 20 (20L and 20R) can be bonded to the head substrate 10 and the like.

In this manner, the ink jet head 3 can avoid complicated and thin common wirings (e.g., the ground wiring 24 and the common connection wiring 26) on the flexible substrates 20 on which the drive IC 8 is mounted. Therefore, it is possible to realize the ink jet printer 1 that is less influenced by noise and can prevent degradation of ejection properties.

As described above, the thickness of the common wiring 16 formed on the head substrate 10 of the ink jet head 3 is 0.4 μm, which is significantly thin. Since drive currents for all the actuators 7 are collected at the common wiring 16, unlike for the discrete wirings 11, a large current flows therethrough. For that reason, the common wiring 16 requires a line width that is about 80 times that of the discrete wirings 11. In the present embodiment, two common wirings 16 with the line width of 0.8 mm are arranged at the edge 10*b*.

The line thickness of the common connection wiring 26 formed on the flexible substrate 20 is 8 μm, which is about 20 times as thick as that of the common wiring 16. Since the cross-sectional area of the common connection wiring 26 is large even if the line width thereof is a half (0.4 mm) of the line width (0.8 mm) of the common wiring 16, the common connection wiring 26 has low electric resistance.

If positional deviations in the left-right direction occur in the bonding between the head substrate 10 and the flexible substrates 20, there is a concern that a part of the common wiring 16 and a part of the common connection wiring 26 are connected to each other and the electric resistance at the connection location increases.

If the electric resistance at the connection location between the common wiring 16 and the common connection wiring 26 is high, a drive voltage of the actuators 7 drops, and stability of ink ejection deteriorates, or the common wiring 16 generates heat, and durability deteriorates.

In the ink jet head 3, the common wiring 16 with a large line width and the common connection wiring 26 with a small line width are connected to each other in an overlapping manner. For that reason, the common connection wiring 26 is reliably arranged within a range of the line width of the common wiring 16. Since the common wiring 16 has a small cross-sectional area and thus high electric resistance is connected to the common connection wiring 26 having a large cross-sectional area and thus low electric resistance, it is possible to avoid an increase in the electric resistance at the connection location.

Therefore, positioning precision for bonding the head substrate 10 and the flexible substrates 20 does not increase, and it is possible to easily perform the bonding.

In the ink jet head 3, the ground wirings 34L and 34R that supply the reference potential GND only to the actuators 7 are disposed on the relay substrate 30. According to this configuration, it is possible to provide switches or the like for the ground wirings 34L and 34R and to arbitrarily control the reference potential to be supplied to the actuator 7.

As illustrated in FIG. 1B, for example, it is possible to supply a negative potential V2 to the actuators 7 by switching the switches. In this manner, it is possible to perform polling processing on the actuators 7.

It is also possible to make the potential V2 variable and to adjust a bias voltage to be applied to the actuators 7.

In the ink jet head 3, the common connection wiring 26 that supplies the reference potential to the actuators 7 and the ground wiring 24 that supplies the reference potential to the drive IC 8 are separately and independently provided on the flexible substrate 20. According to this configuration, it is possible to dispose the output monitor wirings 25 between the output wirings 21 of the drive IC 8 and the common connection wiring 26. The output monitor wirings 25 are connected to any of the plurality of output terminals of the drive IC 8 and are connected to the output monitor wirings 35 on the relay substrate 30.

According to this connection, it is possible to check output waveforms of the drive IC 8 on the relay substrate 30. In other words, it is not necessary to check the output waveforms of the drive IC 8 on the flexible substrates 20 as in the related art.

Therefore, it is possible to easily check the output waveforms of the drive IC 8 when the ink jet head 3 is developed or malfunction thereof is analyzed.

Second Embodiment

Ink Jet Head 4

Figure 5A:
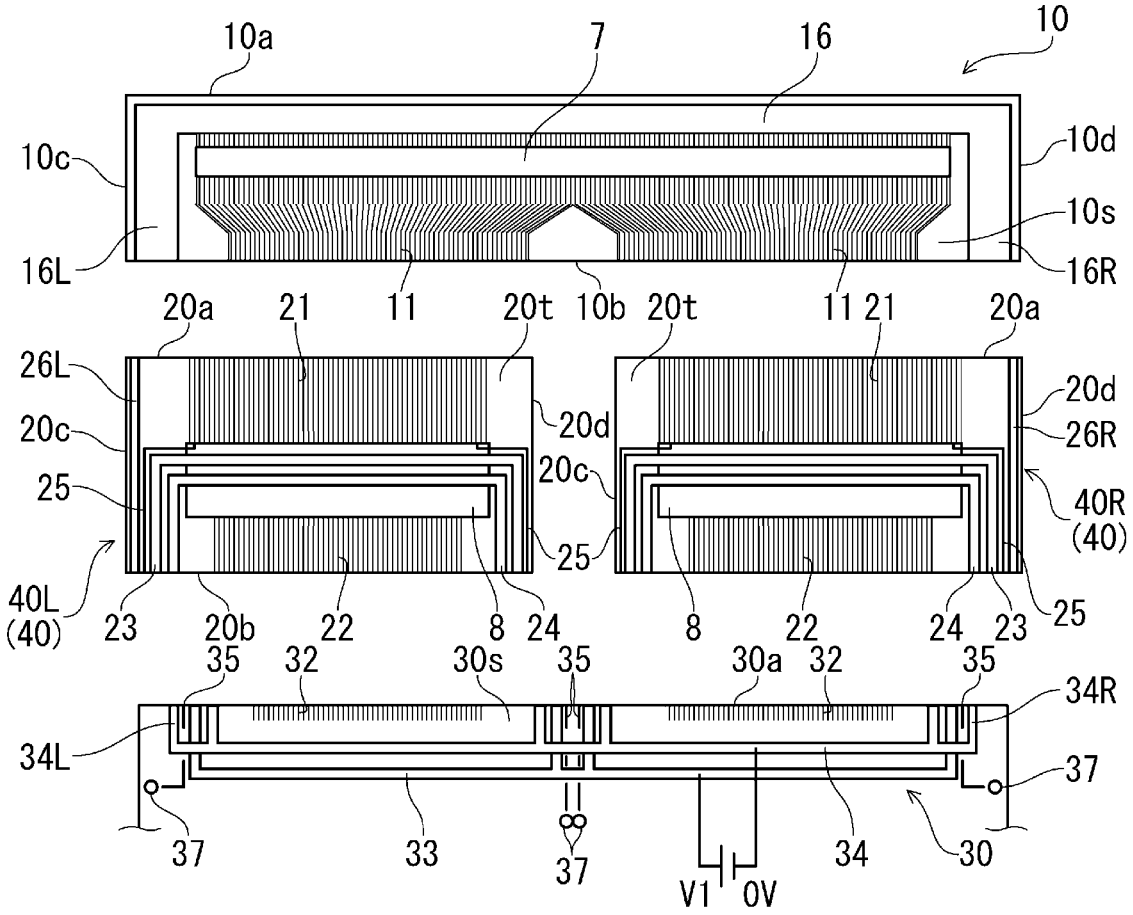
FIGS. 5A and 5B are diagrams illustrating an ink jet head according to a second embodiment, where
Figure 5B:
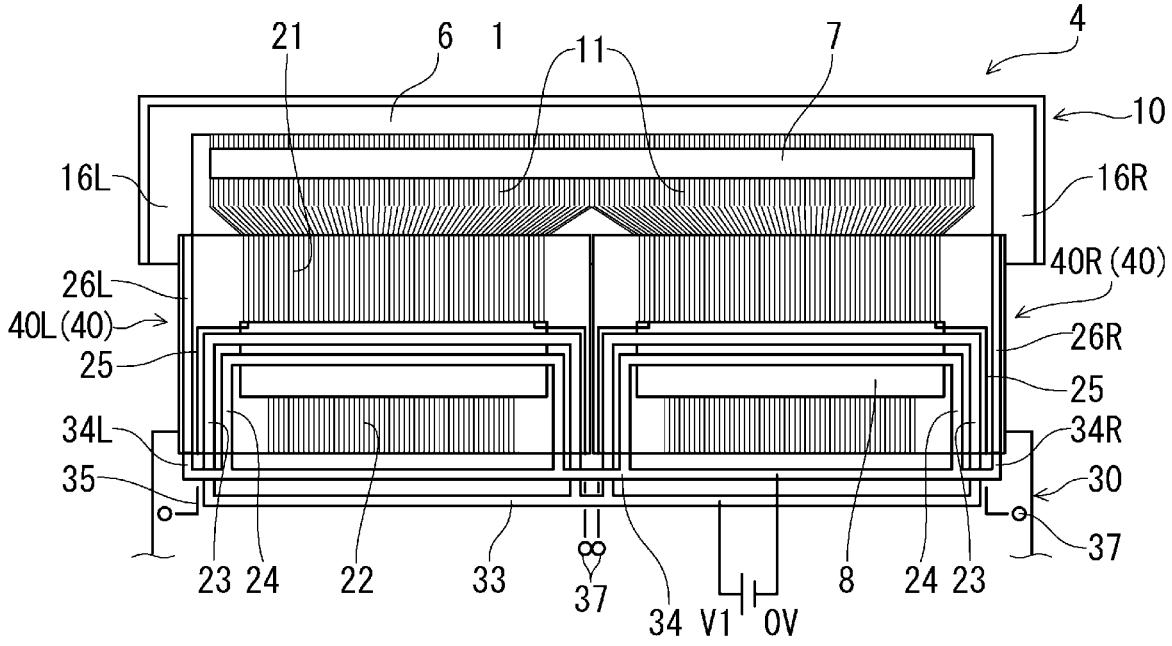

FIGS. 5A and 5B are diagrams illustrating an ink jet head 4 according to a second embodiment, where FIG. 5A illustrates a state before bonding and FIG. 5B illustrates a state after bonding. Wirings and the like on flexible substrates 40 and a relay substrate 30 are illustrated in such a manner in which the wirings and the like are seen through the substrates for convenience of explanation.

The same reference numerals will be used for the same aspects as those in the ink jet head 3, and repeated description thereof is omitted.

The ink jet head 4 includes a head substrate 10, the flexible substrates 40, and the relay substrate 30. Two flexible substrates 40 are bridged in parallel to each other between the head substrate 10 and the relay substrate 30.

Flexible Substrates 40

The flexible substrates 40 have substantially the same configuration as that of the flexible substrates 20.

A flexible substrate 40L on the left side does not have the common connection wiring 26R, and a flexible substrate 40R on the right side does not have the common connection wiring 26L. That is, the flexible substrate 40L is obtained by removing the common connection wiring 26R from the flexible substrates 20, and the flexible substrate 40R is obtained by removing the common connection wiring 26L from the flexible substrates 20.

Figure 6:
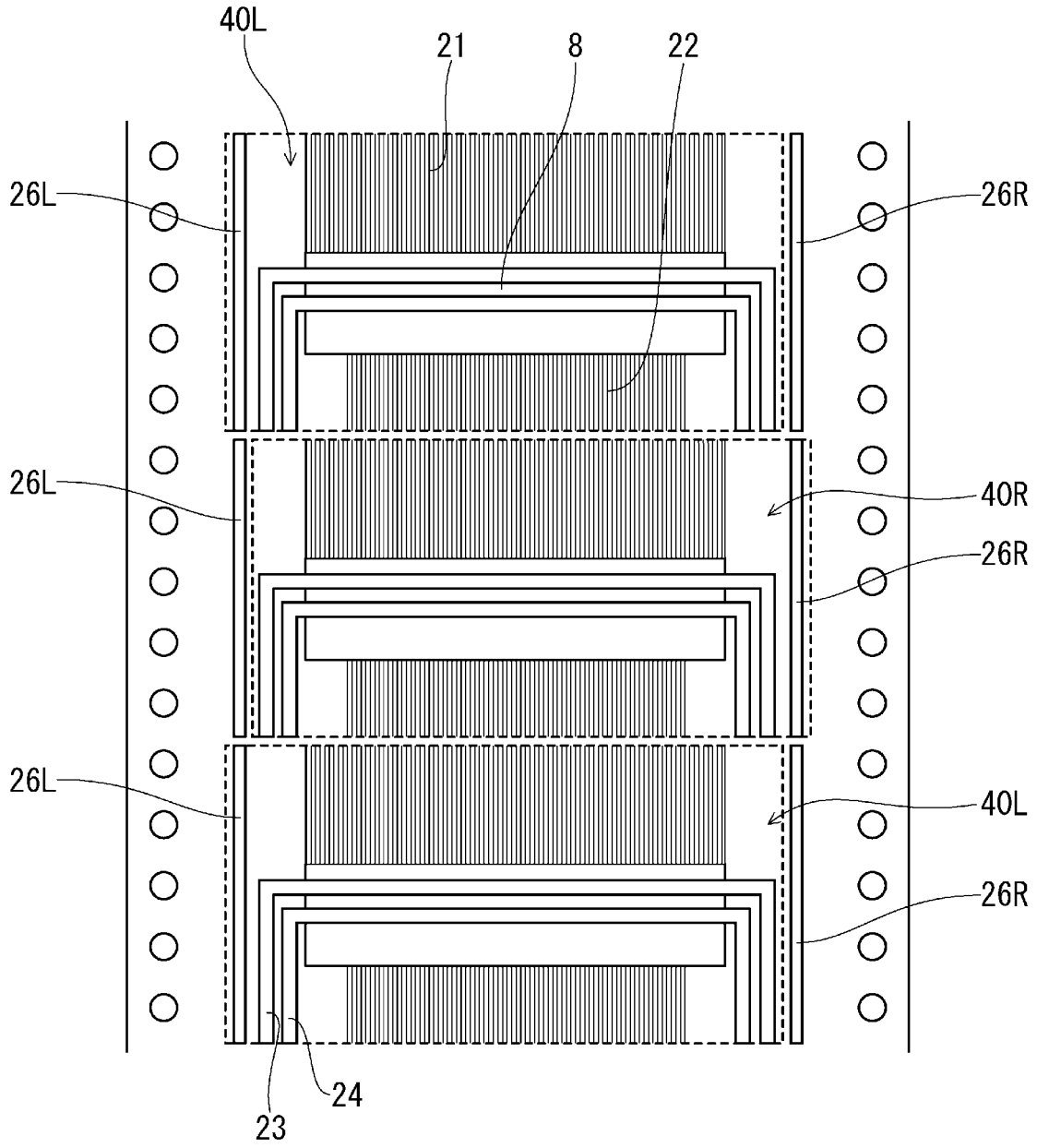
FIG. 6 is a diagram illustrating flexible substrates formed in a sprocket film.

FIG. 6 is a diagram illustrating the flexible substrates 40 formed in a sprocket film F. The flexible substrates 40 are illustrated in a manner in which the flexible substrate 40 is seen through a synthetic resin film for illustrative purpose.

A plurality of flexible substrates 40 is formed continuously in the sprocket film F made. The plurality of flexible substrates 40 is supplied (transported) to an assembling plant or the like while still in the sprocket film F state.

The flexible substrates 40 formed on the sprocket film F have substantially the same configuration as that of the flexible substrates 20 according to the first embodiment. That is, the flexible substrates 40 formed on the sprocket film F have two common connection wirings 26.

When the individual flexible substrates 40R are cut from the sprocket film F, the common connection wirings 26L are left in the sprocket film F (depicted by the broken line in FIG. 6). That is, the common connection wirings 26L are removed from the flexible substrates 40. In this manner, it becomes possible to bond each flexible substrate 40R to the head substrate 10 or the like.

When the individual flexible substrates 40L are cut from the sprocket film F, the common connection wirings 26R are left in the sprocket film F (depicted by the broken line in FIG. 6). That is, the common connection wirings 26R are removed from the flexible substrates 40. In this manner, it becomes possible to bond each flexible substrate 40L to the head substrate 10 or the like.

The ink jet head 4 provides effects and advantages that are similar to those of the ink jet head 3. That is, it is possible to avoid complicated and thin common wirings (e.g., the ground wiring 24 and the common connection wirings 26) on the flexible substrate 40 on which the drive IC 8 for driving the actuators 7 is mounted. Therefore, it is possible to provide the ink jet printer 1 capable of preventing degradation of ejection properties.

Further, the ink jet head 4 can improve manufacturing efficiency. That is, cut lines are differentiated when the individual flexible substrates 40 are cut from the sprocket film F. In this manner, it is possible to cut the flexible substrates 40L and 40R from the sprocket film F on which all the flexible substrates 40 have the same initial configuration.

Since it is only necessary to differentiate the cut lines, the manufacturing efficiency can be improved. Since it is not necessary to manufacture a plurality of types of flexible substrates, it is possible to reduce costs.

As described above, the flexible substrate 40L does not have the common connection wiring 26R, and the flexible substrate 40R on the right side does not have the common connection wiring 26L in the ink jet head 4. For that reason, the widths of the two flexible substrates 40 decrease as compared with the first embodiment.

According to this configuration, it is possible to arrange the plurality of discrete wirings 11, which are divided into two on the left and right sides, near the center on the head substrate 10. That is, it is possible to form the direction in which the discrete wirings 11 are disposed to conform to the upper-lower direction.

If the discrete wirings 11 are disposed such that the discrete wirings 11 are inclined relative to X direction, electric resistance of the respective discrete wirings 11 would become nonuniform, and insulating reliability would deteriorate. Further, this may become a factor of lowering a yield of the head substrate 10.

Figure 12A:
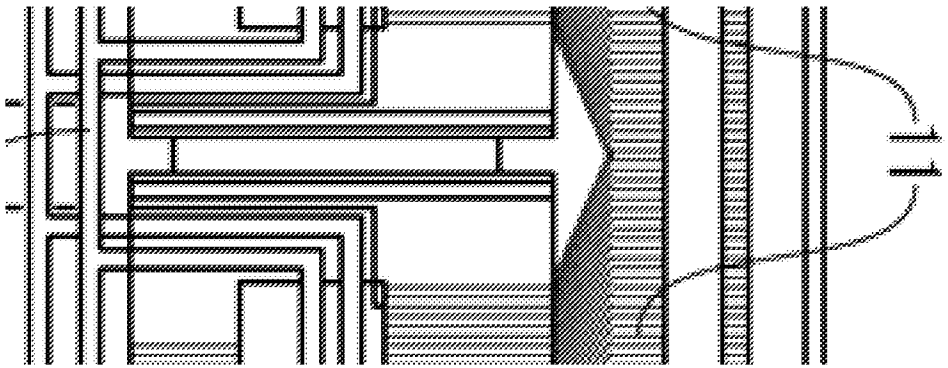
FIGS. 12A and 12B are diagrams illustrating enlarged views of ink jet heads, where
Figure 12B:
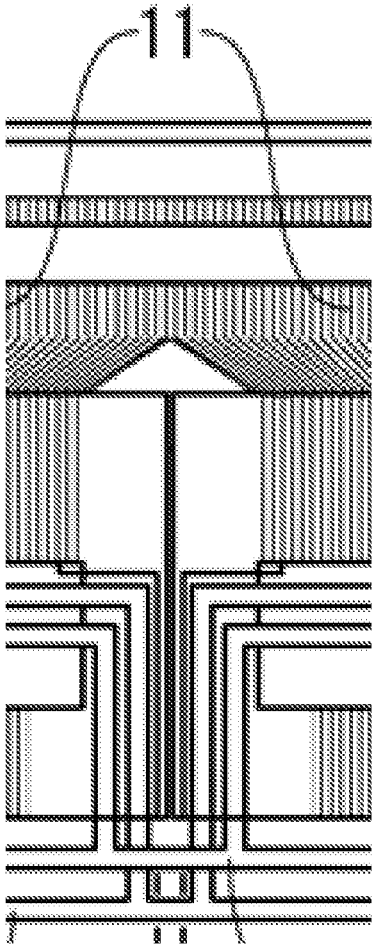

FIGS. 12A and 12B are diagrams illustrating enlarged views of ink jet heads, where FIG. 12A illustrates two flexible substrates separated from each other, and FIG. 12B illustrates two flexible substrates arranged in the vicinity of each other.

According to the ink jet head 4, it is possible to decrease an inclination of the discrete wirings 11 at a center region corresponding to a space between the two flexible substrate 40 by arranging the two flexible substrates 40 in the vicinity of each other in the left-right direction as in FIG. 12B as opposed to that shown in FIG. 12A. It is possible to form the discrete wirings 11 along X direction. As a result, the electric resistance of the respective discrete wirings 11 becomes uniform, the insulating reliability can be improved, and the yield of the head substrate 10 can be improved.

Third Embodiment

Ink Jet Head 5

Figure 7:
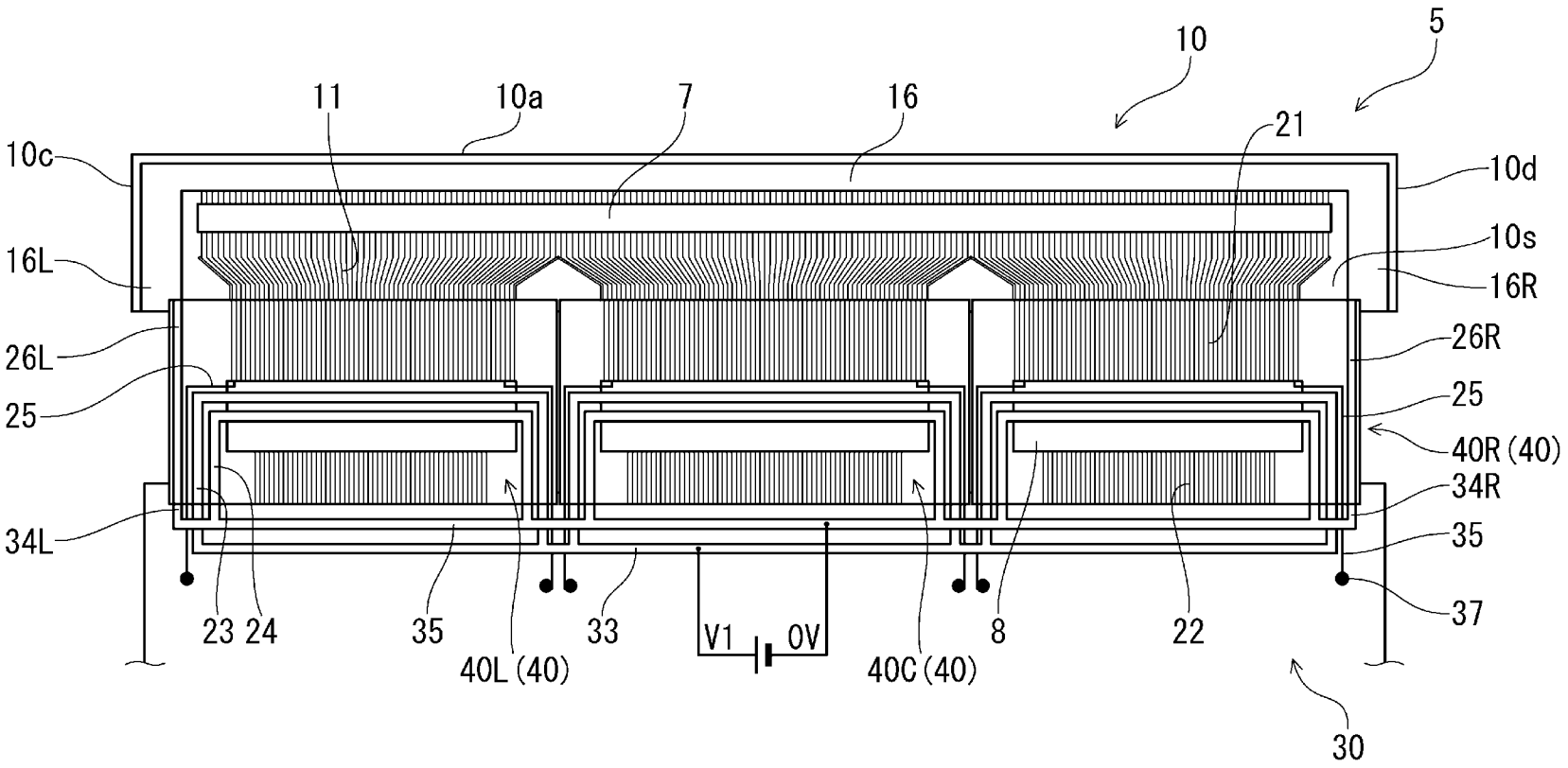
FIG. 7 is a diagram illustrating an ink jet head according to a third embodiment.

FIG. 7 is a diagram illustrating an ink jet head 5 according to a third embodiment. Wirings and the like on flexible substrates 40 and a relay substrate 30 are illustrated in such a manner in which the wirings and the like are seen through the substrates for convenience of explanation.

The same reference numerals will be used for the same aspects and the like as those in the ink jet heads 3 and 4 according to the first and second embodiments, and repeated description thereof will be omitted.

The ink jet head 5 includes a head substrate 10, the flexible substrates 40, and the relay substrate 30. Three flexible substrates 40L, 40C, and 40R are bridged in parallel to each other between the head substrate 10 and the relay substrate 30.

Flexible Substrate 40

The flexible substrate 40L on the left side does not have the common connection wiring 26R, and the flexible substrate 40R on the right side does not have the common connection wiring 26L. The flexible substrate 40C at the center does not have the common connection wiring 26. That is, the flexible substrate 40C is obtained by cutting two common connection wirings 26 from the flexible substrate 20.

Figure 8:
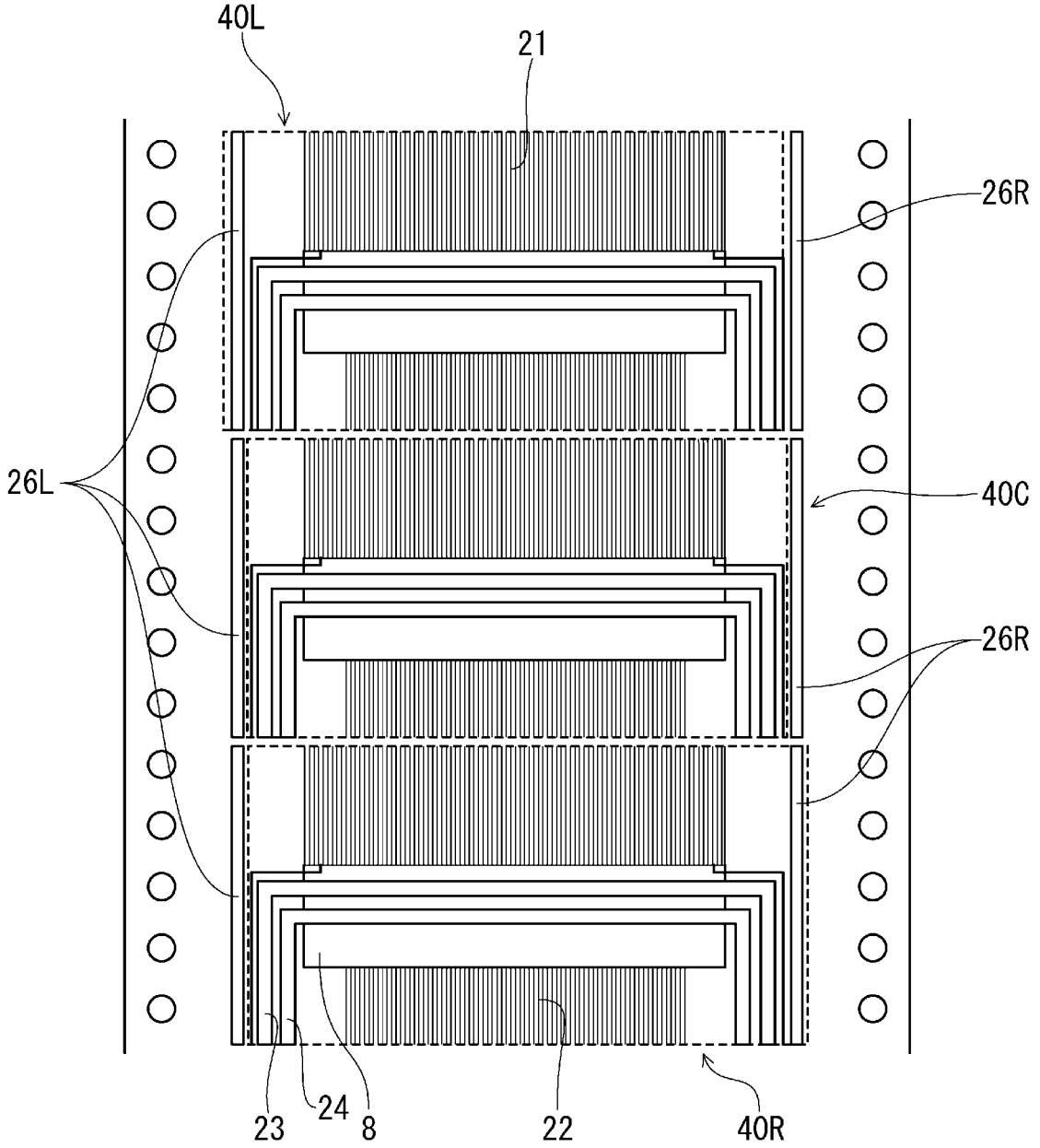
FIG. 8 is a diagram illustrating flexible substrates formed in a sprocket film.

FIG. 8 is a diagram illustrating the flexible substrates 40 formed in a sprocket film F. The flexible substrates 40 are illustrated in such a manner in which the flexible substrates 40 are seen through a synthetic resin film for illustrative purpose.

The flexible substrates 40 are formed continuously in the sprocket film F. The flexible substrates 40 formed in the sprocket film F each have two common connection wirings 26.

When the individual flexible substrates 40R are cut out of the sprocket film F, the common connection wirings 26L are left in the sprocket film F (the broken line in FIG. 8). The common connection wirings 26L are removed from the flexible substrates 40. As a result, it becomes possible to bond each flexible substrate 40R to the head substrate 10 or the like.

When the individual flexible substrates 40C are cut from the sprocket film F, the common connection wirings 26L and 26R are left in the sprocket film F (the broken line in FIG. 8). The common connection wirings 26R are removed from the flexible substrates 40. As a result, it becomes possible to bond each flexible substrate 40C to the head substrate 10 or the like.

When the individual flexible substrates 40L are cut from the sprocket film F, the common connection wirings 26R are left in the sprocket film F (the broken line in FIG. 8). The common connection wirings 26R are removed from the flexible substrate 40. As a result, it becomes possible to bond each flexible substrate 40L to the head substrate 10 or the like.

The ink jet head 5 provides similar effects and advantages as those of the ink jet heads 3 and 4. That is, it is possible to avoid complicated and thin common wirings (e.g., the ground wiring 24 and the common connection wiring 26) on the flexible substrate 40 on which the drive IC 8 is mounted. Therefore, it is possible to provide the ink jet printer 1 that is less influenced by noise and is capable of preventing degradation of ejection properties.

Further, the ink jet head 5 can improve manufacturing efficiency similarly to the ink jet head 4. That is, since the cut lines can be differentiated when the individual flexible substrates 40 are cut from the sprocket film F, it is possible to cut the flexible substrates 40L, 40C, and 40R from the same sprocket film F ion which the flexible substrates 40 all have the same initial configuration.

Since it is only necessary to differentiate the cut lines, the manufacturing efficiency is improved because is not necessary to manufacture a plurality of types of substrates.

It is thus possible to reduce costs.

In the ink jet head 5, the flexible substrate 40L does not have the common connection wiring 26R, the flexible substrate 40R on the right side does not have the common connection wiring 26L, and the flexible substrate 40C does not have the common connection wiring 26.

According to this configuration, it is possible to form the discrete wirings 11 along the upper-lower direction similarly to the ink jet head 5. As a result, electric resistance of the respective discrete wirings 11 becomes uniform, insulating reliability can be improved, and it is possible to improve a yield of the head substrate 10.

Fourth Embodiment

Figure 9:
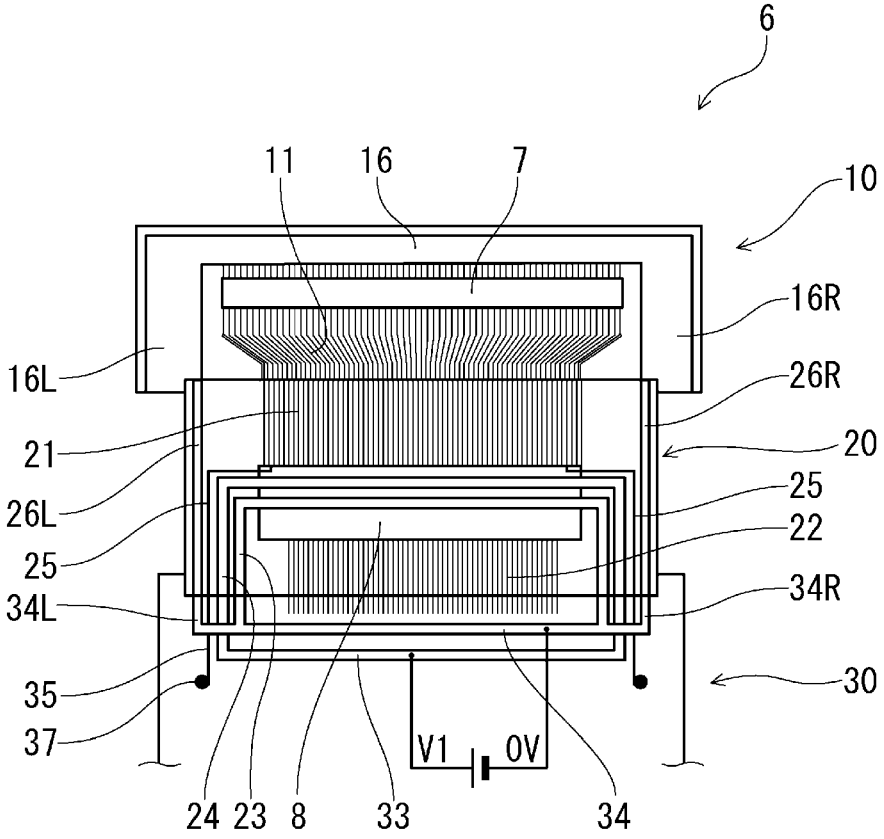
FIG. 9 is a diagram illustrating an ink jet head according to a fourth embodiment.

Ink jet Head 6 FIG. 9 is a diagram illustrating an ink jet head 6 according to a fourth embodiment. Wirings and the like on a flexible substrate 20 and a relay substrate 30 are illustrated in such a manner in which the wirings and the like are seen through the substrates for convenience of explanation.

The same reference numerals will be used for the same aspects and the like as those in the ink jet heads 3 to 5 according to the first to third embodiments, and repeated description thereof will be omitted.

The ink jet head 6 includes a head substrate 10, the flexible substrate 20, and the relay substrate 30. A single flexible substrate 20 is bridged between the head substrate 10 and the relay substrate 30.

The ink jet head 6 provides similar effects and advantages as those of the ink jet heads 3 to 5. That is, it is possible to avoid complicated and thin common wirings (the ground wiring 24 and the common connection wiring 26) on the flexible substrate 20 on which the drive IC 8 for driving the actuators 7 is mounted. Therefore, it is possible to provide the ink jet printer 1 that is less influenced by noise and is capable of preventing degradation of ejection properties.

The aforementioned embodiments are not limited to the case in which the common wiring 16 is a first wiring and the common connection wiring 26 is a second wiring. The discrete wirings 11 may be first wirings, and the output wirings 21 may be second wirings in some cases. Further, the first wiring and the second wiring may be other wirings.

The aforementioned embodiments are not limited to the case in which the head substrate 10 is the first wiring substrate and the flexible substrate 20 is the second wiring substrate. The flexible substrate 20 may be the first wiring substrate, and the relay substrate 30 may be the second wiring substrate in some cases. In such cases, the input wirings 22 are the first wirings, and the input wirings 32 are the second wirings.

The aforementioned respective embodiments are not limited to the case in which a single drive IC 8 is mounted on a single flexible substrate. Two or more drive ICs 8 may be mounted on a single flexible substrate. In this case, the two or more drive ICs 8 may be arranged in series in the left-right direction.

The elements that cause the nozzles to eject ink are not limited to actuators 7 formed by piezoelectric elements. These elements may instead be heaters or solenoid valves.

The shape of each substrate is not limited to a rectangular shape and may be a parallelogram, a trapezoid, or the like. The wirings are not limited to the case in which the wirings are disposed linearly or in parallel, and various modifications (e.g., bends) can be made as needed.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. An ink jet head, comprising:

a first substrate including a first wiring;

a second substrate coupled to the first substrate, the second substrate including a second wiring overlaid on the first wiring at a connection region;

a plurality of ink jet elements configured to cause ink to be ejected from a plurality of nozzles; and a drive circuit provided on the first substrate and configured to drive the plurality of ink jet elements, a thickness of the first wiring at the connection region being less than a thickness of the second wiring at the connection region, and a width of the first wiring at the connection region being greater than a width of the second wiring at the connection region.

2. The ink jet head according to claim 1, wherein the first wiring and the second wiring are electrically connected by an anisotropic conductive film at the connection region.

3. The ink jet head according to claim 1, wherein the thickness of the second wiring at the connection region is at least 20 times greater than the thickness of the first wiring at the connection region.

4. The ink jet head according to claim 1, wherein the first substrate is a printed substrate.

5. The ink jet head according to claim 1, wherein the first wiring is one of a plurality of signal input wirings that are arranged in parallel to each other at a first pitch, and the second wiring is one of a plurality of signal output wirings that are arranged in parallel to each other at a second pitch equal to the first pitch.

6. An ink jet head, comprising:

a first substrate including a first wiring;

a second substrate coupled to the first substrate, the second substrate including a second wiring overlaid on the first wiring at a connection region;

a plurality of ink jet elements on the first substrate configured to cause ink to be ejected from a plurality of nozzles; and a thickness of the first wiring at the connection region being less than a thickness of the second wiring at the connection region, and a width of the first wiring at the connection region being greater than a width of the second wiring at the connection region, wherein the first wiring is a common wiring extending from an edge of the first substrate and electrically connected in common to the plurality of ink jet elements, and the second wiring is a common connection wiring extending between a first edge of the second substrate and a second edge of the second substrate opposite the first edge.

7. The ink jet head according to claim 6, further comprising:

a drive circuit provided on the second substrate and configured to drive the plurality of ink jet elements.

8. The ink jet head according to claim 6, wherein the second substrate is a printed substrate.

9. The ink jet head according to claim 6, wherein the first wiring and the second wiring are electrically connected by an anisotropic conductive film at the connection region.

10. The ink jet head according to claim 6, wherein the first substrate is an inflexible substrate.

11. The ink jet head according to claim 6, wherein the thickness of the second wiring at the connection region is at least 20 times greater than the thickness of the first wiring at the connection region.

12. An ink jet head, comprising:

a first substrate including a first wiring;

a second substrate coupled to the first substrate, the second substrate including a second wiring overlaid on the first wiring at a connection region and a third wiring;

a third substrate coupled to the second substrate, the third substrate having a fourth wiring overlaid on the third wiring at a second connection region;

a plurality of ink jet elements configured to cause ink to be ejected from a plurality of nozzles; and a drive circuit provided on the first or second substrate and configured to drive the plurality of ink jet elements, a thickness of the first wiring at the connection region being less than a thickness of the second wiring at the connection region, and a width of the first wiring at the connection region being greater than a width of the second wiring at the connection region, and a thickness of the third wiring at the second connection region being less than a thickness of the fourth wiring at the second connection region, and a width of the third wiring at the second connection region being greater than a width of the fourth wiring at the second connection region.

13. The ink jet head according to claim 12, wherein the first wiring is one of a plurality of signal input wirings that are arranged in parallel to each other at a first pitch, and the second wiring is one of a plurality of signal output wirings that are arranged in parallel to each other at a second pitch equal to the first pitch.

14. The ink jet head according to claim 12, wherein the first wiring and the second wiring are electrically connected by an anisotropic conductive film at the connection region.

15. The ink jet head according to claim 12, wherein the first substrate is an inflexible substrate.

16. The ink jet head according to claim 12, wherein the second substrate is a printed substrate.

17. The ink jet head according to claim 12, wherein the drive circuit is provided on the second substrate.

18. The ink jet head according to claim 17, wherein the plurality of ink jet elements are provided on the first substrate.

19. The ink jet head according to claim 18, wherein the first wiring is a common wiring extending from an edge of the first substrate and electrically connected in common to the plurality of ink jet elements, and the second wiring is a common connection wiring extending between a first edge of the second substrate and a second edge of the second substrate opposite the first edge.

20. The ink jet head according to claim 18, wherein the first wiring is connected to a signal input terminal of one of the ink jet elements, and the second wiring is connected to a signal output terminal of the drive circuit.

* * * * *